US006865916B2

(12) United States Patent
Goldman

(10) Patent No.: US 6,865,916 B2
(45) Date of Patent: Mar. 15, 2005

(54) DOOR CYLINDER LOCK

(76) Inventor: Ilan Goldman, 3 Hayasmin Street, Hersliya 46631 (IL)

( * ) Notice: Subject to any disclaimer, the term of this patent is extended or adjusted under 35 U.S.C. 154(b) by 0 days.

(21) Appl. No.: 10/229,156

(22) Filed: Aug. 28, 2002

(65) Prior Publication Data

US 2004/0040355 A1 Mar. 4, 2004

(51) Int. Cl.[7] ..... E05B 13/00

(52) U.S. Cl. ..... 70/472; 70/149; 70/218; 70/223; 70/278.2; 70/278.3; 70/279.1; 292/DIG. 27

(58) Field of Search ..... 70/188, 189, 218, 70/222, 223, 224, 149, 472, 422, 276, 277, 279.1, 278.1, 278.2, 278.3, 278.7, 283, 283.1; 292/144, DIG. 27

(56) References Cited

U.S. PATENT DOCUMENTS

| | | | | | |
|---|---|---|---|---|---|
| 4,197,524 | A | | 4/1980 | Salem | 340/147 MD |
| 4,250,533 | A | * | 2/1981 | Nelson | 361/172 |
| 4,393,672 | A | * | 7/1983 | Gelhard | 70/277 |
| 4,736,970 | A | * | 4/1988 | McGourty et al. | 292/359 |
| 4,745,785 | A | * | 5/1988 | Uebersax | 70/380 X |
| 4,848,115 | A | * | 7/1989 | Clarkson et al. | 70/276 |
| 5,018,375 | A | * | 5/1991 | Tully | 70/472 |
| 5,421,178 | A | * | 6/1995 | Hamel et al. | 70/283 |
| 5,447,047 | A | * | 9/1995 | Lin | 70/218 |
| 5,473,236 | A | * | 12/1995 | Frolov | 70/277 X |
| 5,552,777 | A | * | 9/1996 | Gokcebay et al. | 340/5.54 |
| 5,694,798 | A | * | 12/1997 | Nunez et al. | 70/283 |
| 5,839,305 | A | * | 11/1998 | Aston | 70/283.1 |
| 5,946,956 | A | * | 9/1999 | Hotzl | 70/276 |
| 6,158,259 | A | * | 12/2000 | Schmitz et al. | 70/276 |
| 6,264,256 | B1 | * | 7/2001 | Hankel et al. | 292/336.3 |
| 6,378,344 | B1 | | 4/2002 | Gartner | 70/278.1 |
| 6,411,195 | B1 | | 6/2002 | Goldman | 70/278.1 X |
| 6,418,764 | B1 | * | 7/2002 | Lerchner | 70/279.1 |
| 2003/0217574 | A1 | * | 11/2003 | Meis | 70/257 |

FOREIGN PATENT DOCUMENTS

| | | | | |
|---|---|---|---|---|
| DE | 42 34 321 A1 | | 4/1994 | |
| DE | 297 03 559 U1 | | 4/1997 | |
| DE | 198 54 879 C1 | | 8/2000 | |
| DE | 199 30 054 C2 | | 1/2001 | |
| EP | 0 588 209 A1 | | 3/1994 | |
| EP | 1 065 335 A1 | | 1/2001 | |
| FR | 2 761 396 | | 10/1998 | |
| GB | 2178476 | * | 2/1987 | 70/278.3 |
| GB | 2211239 | * | 6/1989 | 70/283 |
| WO | WO 92/21844 | | 12/1992 | |
| WO | WO 97/48867 | | 12/1997 | |
| WO | WO98/44224 | | 10/1998 | |
| WO | WO 99/61728 | | 12/1999 | |

* cited by examiner

*Primary Examiner*—Lloyd A. Gall
(74) *Attorney, Agent, or Firm*—Birch, Stewart, Kolasch & Birch, LLP.

(57) ABSTRACT

A cylinder lock for use in a door lock, comprising an outer plug, an inner plug, a rotary cam adapted to move a deadbolt of the door lock, and a clutch adapted to engage for rotation the outer plug to the rotary cam. The cylinder lock further comprises an electronic blocking device (EBD) and a drive adapted to actuate the clutch upon an unblocking command from the EBD generated upon receiving therein an unblocking signal emitted from the outer side of the door, thereby enabling moving the deadbolt by rotation of the outer plug. The cylinder lock comprises an inner handle attached thereto at the inner side of the door, the EBD and the drive being entirely accommodated within the inner handle. The signal is emitted by an electronic key or panel and may be a mechanical vibration signal, a light signal, or a radio signal.

28 Claims, 3 Drawing Sheets

DOOR CYLINDER LOCK

FIELD OF THE INVENTION

This invention relates to door cylinder locks, and specifically to electronic door locks that are opened by coded input signal.

BACKGROUND OF THE INVENTION

Cylinder locks are widely known and used as locking mechanisms in doors, windows, boxes, cases, drawers, safes, padlocks, bicycle locks, etc. The mechanical cylinder lock has one or two cylinder-shaped plugs rotatable by an inserted key to move a locking bolt from the door into the door frame or backwards, thereby locking or unlocking the door. The mechanical varieties of cylinder locks are standardized to allow mass production and convenient replacement and retrofitting of existing doors. Examples of conventional mechanical cylinder locks such as Euro Profile cylinder lock 1, Swiss cylinder 2, and Schlage® cylinders 3 and 4 are shown in FIG. 1.

Electronic locks are also known. Some electronic locks have a keypad control panel near the door or on the door itself, which is used to input an entry code. Other types have magnetic card readers for input of the entry code, as used in hotels and some condominiums. Yet others have sophisticated receivers and may be operated remotely, for example door locks of cars. Electronic locks generally offer a higher level of security and convenience than the mechanical locks, however they need specially designed and manufactured locks, power supply and wiring. They are more expensive for installation and maintenance and more susceptible to accidental or ill-intended damage.

There are attempts to combine the advantages of the electronic locks and the mechanical locks, especially when retrofitting existing doors with new electronic locks. US Pat. Application 2001/0027671 discloses a system comprising electronic cylinders and electronic keys. The electronic cylinder has no power supply but has a built-in microprocessor and memory chip and electric contacts in a recess accepting the key bit. The electronic key contains a battery to operate the cylinder, and a microprocessor with memory. The key serves also as a handle to turn the cylinder in the lock and to open the lock bolt.

WO 99/61728 discloses an electronic cylinder lock comprising an inner and an outer cylinder plug, a battery, a servomotor, a control unit, and a mechanical clutch. The servomotor and the clutch are disposed in the cylinder between the plugs, in a rotary cam engaged with the locking bolt. An electronic key for this lock is described in WO 97/48867. The coded signal is transmitted via electric contacts in the key bit and in a recess in the cylinder plugs. Normally, neither cylinder plug is engaged to the rotary cam. When a key is inserted in one of the plugs and the coded signal is recognized, the servomotor operates the clutch and connects the plug to the rotary cam.

While each of the above constructions has its advantages, it is desirable to avoid some deficiencies such as electric contacts or any code-input devices exposed to tampering or malevolent damage, etc.

WO92/21844 and DE 4234321A1 disclose an electronic cylinder lock containing a battery, a servomotor, a control unit, and an optical guide disposed along the cylinder axis and reaching the outer surface of the cylinder (the recess for the key). A key with a battery, a microprocessor, and a light source is inserted in the recess and a coded light signal is emitted. The signal passes through the optical guide to a control unit sensor, and after identification, the servomotor releases the cylinder, which can now be rotated by the key to move the door lock bolt.

U.S. Pat. No. 6,411,195 discloses a data transmission system including a data transmitting device having a reciprocable impact head for delivering an encoded series of mechanical impacts to a first surface of an impact transmissive body such as a door, and a data receiving device having a sensitive microphone at a second surface of the impact transmissive body for picking up vibrations resulting from the series of impacts. The data transmission system is suitable for use in coded access systems.

SUMMARY OF THE INVENTION

In accordance with the present invention, there is provided a cylinder lock for use in a door lock mounted in a door having an outer and an inner side. The cylinder lock comprises an outer plug, an inner plug, a rotary cam adapted to move a deadbolt of the door lock, and a clutch adapted to engage for rotation the outer plug to the rotary cam. The cylinder lock further comprises an electronic blocking device (EBD) and a drive means adapted to actuate the clutch upon an unblocking command from the EBD generated upon receiving therein an unblocking signal emitted from the outer side of the door, thereby enabling moving the deadbolt by rotation of the outer plug. The cylinder lock comprises an inner handle attached thereto at the inner side of the door, the EBD and the drive means being entirely accommodated within the inner handle.

The inner handle is preferably detachable from the cylinder lock without a need to dismantle the door lock or the door or any part of them. The inner handle is attachable to the cylinder lock by fastening means accessible from the inner side of the door, along a surface free of electric contacts and free of any connections preventing detaching of the inner handle from the cylinder lock after the fastening means are released.

The drive means is preferably a bi-stable solenoid adapted to actuate the clutch via a rod extending axially and passing slidingly through the inner plug, between the clutch and the inner handle.

Preferably, the unblocking signal is coded, the EBD is adapted to decode the signal, to match it to a lock access code programmed therein, and to generate the unblocking command after the matching.

The cylinder lock of the present invention further comprises a signal emitter adapted to emit the unblocking signal from the outer side of the door. The signal emitter preferably encodes the signal according to a key access code programmed therein.

In one embodiment, the signal emitter is an electronic panel with a keypad fixed to the outer side of the door, or fixed to the outer plug and adapted for use as a handle to move the deadbolt.

In another embodiment, the signal emitter is a movable electronic key. Preferably, the electronic key and the outer plug are configured so as to be able to engage each other for rotation, whereby the electronic key may be used as a handle to move the deadbolt. The electronic key may have a key bit, the key bit and the outer plug being configured as in a conventional mechanical cylinder lock. In this case, the EBD and the drive means may be adapted to be restorably switched into a state where the clutch is continuously actuated, thereby allowing the electronic key to be used as a mechanical key and allowing usage of mechanical keys.

The electronic key may comprise a keypad for programming of the key access code, and may be adapted to be fixed to the outer plug, thereby being usable both as a handle for moving the deadbolt and as a standing keypad panel for entering the key access code into the EBD.

The unblocking signal used in the cylinder lock of the present invention may be a mechanical vibration signal (sound or ultrasound), a light signal (visible, IR, or UV), or a radio signal, the EBD comprising a respective sensor for receiving the unblocking signal.

In an embodiment of the cylinder lock, where the unblocking signal is a mechanical vibration signal, the signal emitter has an impact head adapted to deliver the vibration signal to the outer side of the door. The impact head may be of electromagnetic type or of piezoelectric type or of magnetostriction type.

In an embodiment of the cylinder lock, where the unblocking signal is a light signal, the door lock has a light-guide adapted to conduct said light signal from said signal emitter to said EBD. The light-guide may be a bore extending between the outer side and the inner side of the cylinder lock, or may be partially a light-transmissive solid body, preferably disposed at the axis of the outer and inner plugs. The light-guide may be disposed in a tubular rod extending axially through the inner plug, between the clutch and the inner handle.

The cylinder lock of the present invention may comprise a dummy inner handle attachable instead of the inner handle with the EBD. The dummy inner handle is configured so that, when attached, the clutch may be continuously actuated, thereby provisionally allowing moving the deadbolt without the unblocking command.

The cylinder lock of the present invention is designed as a modular structure. All electronic control circuits, sensors, drives, batteries, etc. are concentrated in one detachable module which is the inner handle. A second module is a housing accommodating the inner and outer plugs, the rotary cam and the clutch. Due to the nature of the unblocking signal that is transmitted as a vibration through the body of the door lock, or through a light-guide, or as radio waves, the second module has no electric or electronic parts requiring connections to the first module. After mounting the second module in the door, the first module can be assembled to the second by simple screws, bolts or other means without disassembling the door lock and without disconnecting and connecting signal or power lines in the door lock.

The modularity of the cylinder lock constitutes considerable convenience in the assembly of new door locks or in retrofitting existing door locks. The modularity also provides for great flexibility in changing the access level of individual rooms by replacing the inner handles.

BRIEF DESCRIPTION OF THE DRAWINGS

In order to understand the invention and to see how it may be carried out in practice, preferred embodiments will now be described, by way of non-limiting examples only, with reference to the accompanying drawings, in which.

DETAILED DESCRIPTION OF THE INVENTION

Figure 1:
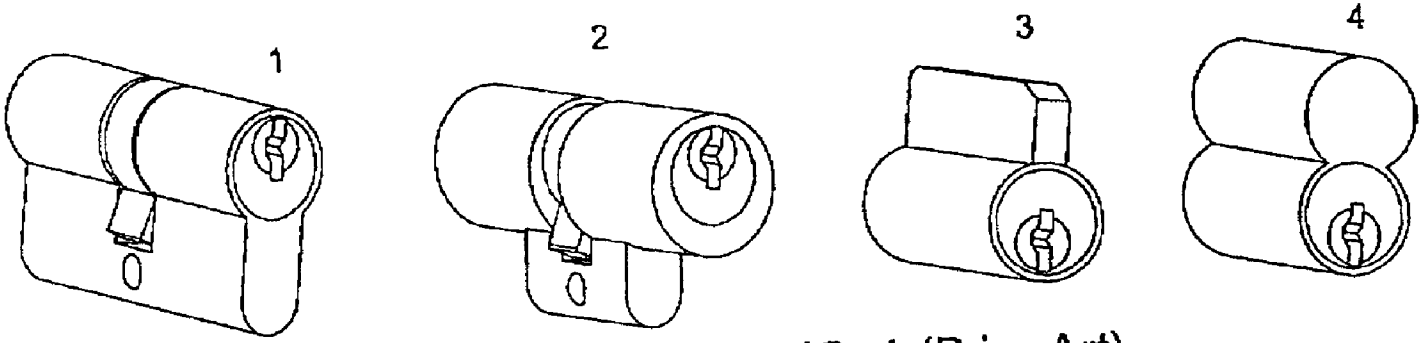
FIG. 1 (Prior Art)
FIG. 1 is a perspective view of four standard mechanical cylinder locks known from the prior art.

With reference to FIGS. 2, 3A, 3B and 4, a cylinder door lock 10 of the present invention comprises a handle assembly 12, a housing 14 with an outer plug 16, an inner plug 18 and a rotary cam 20, and an outer knob 22. The handle assembly 12 is attached to the inner plug 18. The housing 14 and the rotary cam 20 have the size and the form of a standard cylinder lock and can be retrofitted in any standard door lock. A standard door lock is locked by a deadbolt which, under the action of the rotary cam 20, can slide into a notch in the doorframe (the door lock, the deadbolt and the doorframe are not shown). In the following, it is assumed that the handle assembly 12 is at the inner side of the door (room side), while the outer plug 16 and the outer knob 22 face the outer side (corridor or street side).

The two plugs 16 and 18 are rotatably accommodated in the housing 14 together with the rotary cam 20 and are held in place by two retaining bolts 24 that allow only rotation of the plugs. The rotary cam 20 is engaged for rotation to the inner plug 18 by a radial pin 25.

The outer plug has a cylindrical recess 28 and a diametric slit 30 across the recess. A C-shaped sliding clutch 32 is received in the slit 30. A compression cylinder spring 34 is accommodated in the recess 28, urging the sliding clutch 32 towards the inner plug 18. The outer knob 22 is firmly mounted to the outer plug. The inner plug 18 has a diametric slit 38, and a through axial bore 40. A sliding rod 42 is accommodated in the axial bore 40, abutting the sliding clutch 32.

The handle assembly 12 comprises a hollow handle 44 fixed to the inner plug 18 by means of screws 45, and a cover 46. It accommodates a battery 48, a blocking drive 50, and an electronic blocking device (EBD) 52. The handle 44 has an axial opening for the sliding rod 42.

Figure 2:
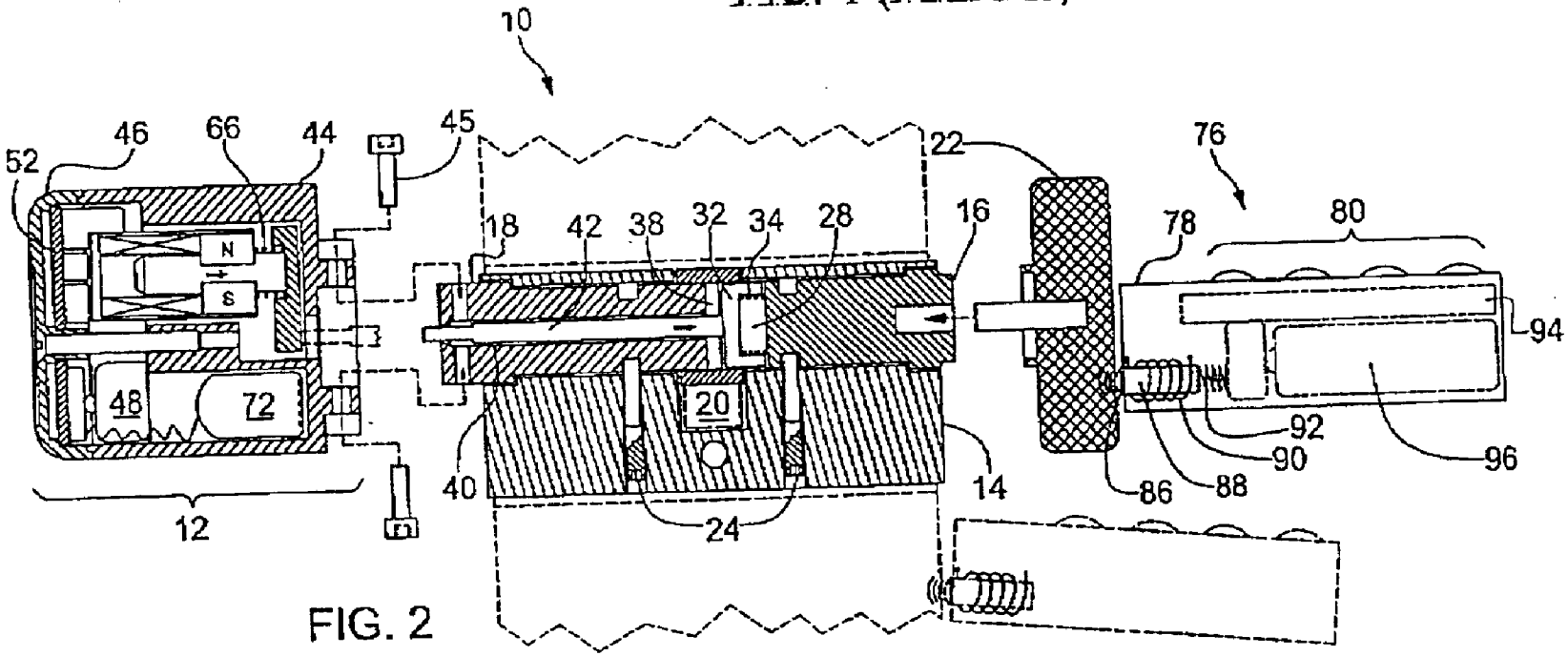
FIG. 2 is a sectional exploded view of a cylinder door lock according to the present invention, with opening from outside disabled.
Figure 3A:
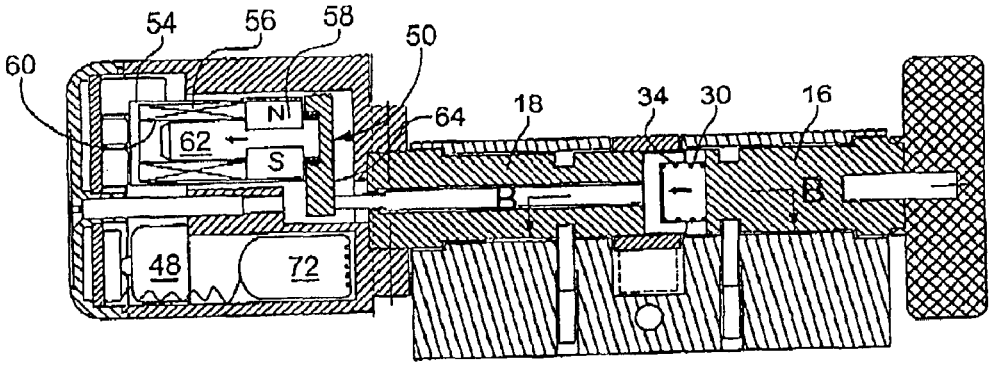
FIG. 3A is a sectional elevation of the cylinder door lock in FIG. 2, with opening from outside enabled.
Figure 4:
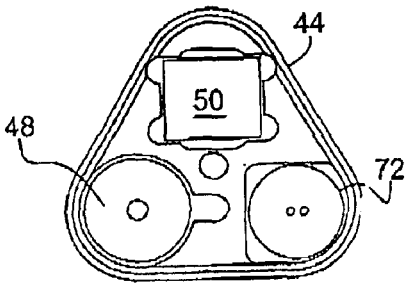
FIG. 4 is a view of the handle of the door lock in FIG. 1, with removed cover.
Figure 3B:
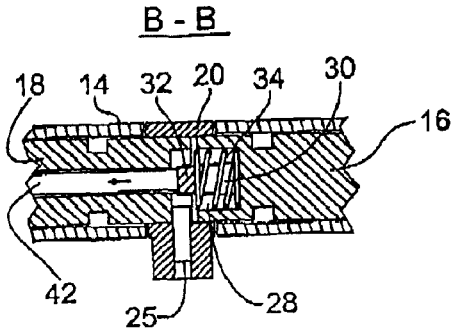
FIG. 3B is a partial section of the cylinder door lock in FIG. 3A, along lines B—B.

The blocking drive 50 is a bi-stable solenoid. It is fixed in the handle assembly 12 and comprises a housing 54 with an electromagnetic coil 56 and a permanent magnet 58 formed with a cylindrical bore 60. The blocking drive 50 further comprises an armature 62 movable in the bore 60, with a cap 64. The cap 64 abuts the end of the sliding rod 42. A compression spring 66 urges the armature 62 away from the magnet 58. The armature 62 has two stable states: an open state with the cap 64 urged away from the magnet (as shown in FIG. 2), and a closed state with the cap 64 close to the magnet 58 and the spring 66 compressed (as shown in FIG. 3A).

When the cylinder door lock 10 is in blocked state (see FIG. 2), the blocking drive 50 is open, the spring 66 urges the cap 64, the abutting sliding rod 42, and the sliding clutch 32 towards the outer plug 16, overcoming the action of the compressed spring 34. Thereby, the clutch 32 stays completely out of the slit 38 and completely in the slit 30. The outer plug 16 can be only rotated freely by the knob 22 without affecting the position of the cam 20. Thus, the door lock cannot be locked or unlocked.

When the cylinder door lock 10 is in unblocked state (see FIGS. 3A and 3B), the blocking drive 50 is closed, the cap 64 being attracted to the magnet 58 overcoming the action of the compressed spring 66. The sliding rod 42 and the sliding clutch 32 are urged towards the inner plug 18 by the action of the spring 34. Thereby, the clutch 32 is received in the slit 38 and the outer plug 16 is engaged for rotation to the inner plug 18 and therefore to the cam 20. Now, a rotation of the knob 22 will rotate also the cam 20 and the door lock may thereby be locked or unlocked.

The transition between blocked and unblocked states of the door lock is performed by activation of the electromagnetic coil 56 upon a command from the EBD 52. The relative strength of the springs 66 and 34 is selected so that, without any magnetic force, the force of the expanded spring 66 is greater than the force of the compressed spring 34, whereby the door lock stays in the blocked state shown in FIG. 2. Now, if the coil 56 is energized to create magnetic force complementary to the force of the permanent magnet 58, the armature 62 will be attracted towards the coil 56, overcoming the action of the spring 66. When the cap 64 comes closer to the magnet 58, the latter is able to hold the blocking drive in closed state and the door lock unblocked, without further help from the electromagnetic coil 56, so that the coil can be de-energized.

In the closed state of the blocking drive, if the coil 56 is energized to create magnetic force opposite to the force of the permanent magnet 58, the armature 62 and the cap 64 will be urged by the action of the spring 66 away from the permanent magnet 58, thereby switching the door lock into blocked state. When the cap 64 is far from the magnet 58, the latter cannot draw the cap back even without the opposing force of the electromagnetic coil 56, so that the coil can be de-energized.

The electronic blocking device 52 includes a receiver of coded signal such as impact sensitive microphone 72, and a programmable controller with memory. The controller is adapted to decode a signal received by the microphone and to compare it to a lock access code stored in the memory. An access control system using the cylinder door lock 10 with the EBD 52 is completed by an external coded signal emitter such as an impact generating electronic key 76. Signal-transmitting media is advantageously the door lock itself and/or the body of the door. The lock access code may be programmed and reprogrammed in the EBD memory by means of a special portable device using a special code transmitted by a similar impact signal.

The electronic key 76 is a hand-held programmable data-transmitting device. It includes a housing 78 with a numeric keypad 80 at the face side and an impact head 86 which is part of an armature 88 received in a solenoid coil 90 and biased by a spring 92. The key 76 further comprises a programmable controller 94 with memory and a battery 96. The key 76 is designed to produce a coded series of pulse-like, high-energy impacts of the impact head, in accordance with a key access code stored in the memory. Methods of coding a series of impacts are described in U.S. Pat. No. 6,411,195, included herein by reference.

In operation, the key 76 is urged by hand to any point of the door lock or to the door itself (see FIG. 2). A key access code is input via the keypad 80 and a corresponding coded series of impacts is delivered by the solenoid 90 and the armature 88 to the surface of the door. Alternatively, the key access code may be pre-programmed in the memory or pre-dialed, in which case a coded series of impacts may be initiated by pressing a single button on the keypad 80. The microphone 72 picks up vibrations at the door's inside surface resulting from the impacts delivered to the door. The vibrations are suitably processed and decoded by the controller of the EBD 52, and are then compared to the lock access code programmed in the memory of the EBD 52. Upon successful match, the EBD 52 energizes the coil 56 to unblock the cylinder lock as explained above. Now, the knob 22 may be turned manually to move the deadbolt of the door lock via the outer plug 16, the clutch 32, the inner plug 18, and the cam 20. In a predetermined interval of time, the EBD automatically energizes the coil 56 to disengage the clutch 32 and thereby to block the cylinder lock again.

Figure 5:
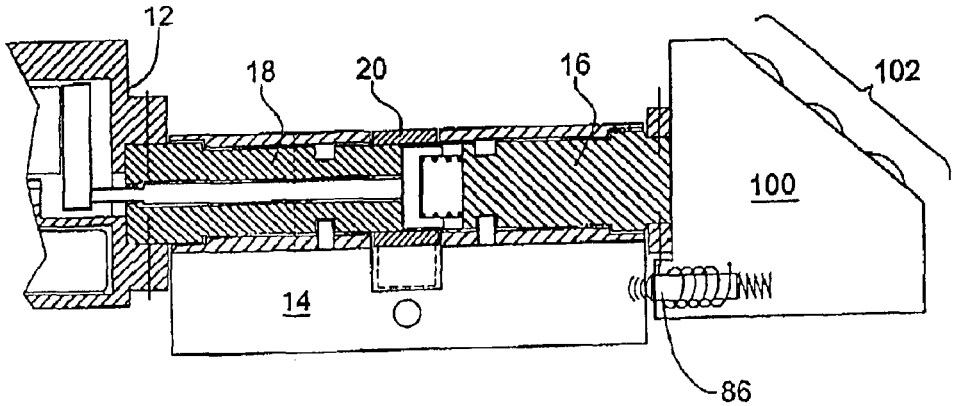
FIG. 5 illustrates a second embodiment of the cylinder door lock, with a permanent electronic panel-handle.

The signal emitter with an impact head may be designed as a standing keypad panel for access code input and be mounted firmly in any suitable place at the outer surface of the door. A particular embodiment is shown in FIG. 5 where a keypad panel formed as an outer handle 100 with a keypad 102 is permanently fixed to the outer plug 16 instead of the knob 22.

The electronic key 76 with the keypad 80 can be used as a temporary keypad panel and handle. For such use, the knob 22 and the key 76 may be formed with snapping or fixing elements to ensure stable mechanical connection therebetween.

The electronic key may be formed without a numeric keypad, with an actuation button only. The key access code in this case may be programmed and reprogrammed in the controller of the key by known methods, for example by magnetic record or by methods of EPROM burning.

Figure 6:
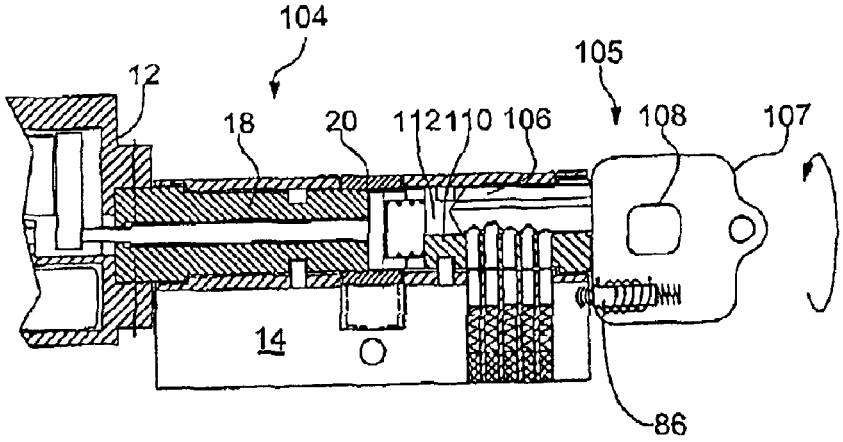
FIG. 6 illustrates a third embodiment of the cylinder door lock, with a mechanical outer plug and a combined key.

An example of such key is shown in an embodiment of the cylinder lock 104 illustrated in FIG. 6. An electronic impact key 105 comprises a key bit 106 and a key handle 107, and has only a programmable controller, impact head 86 and an actuation button 108. An outer plug 110 of the cylinder lock is formed with a recess 112 adapted to receive the key bit 106. In this case the key bit 106 and the outer plug 110 may have the conventional construction of the mechanical cylinder locks shown in FIG. 1 (prior art) and the key 105 will be a combined key for use both as electronic and mechanical key. This design of the electronic cylinder lock allows to establish different levels of access by switching the state of the cylinder lock from inside. For example, a switch in the handle assembly 12 may toggle the cylinder lock into a permanent unblocked state whereby the lock will be openable by mechanical flat keys with a suitable bit 106.

Figure 7:
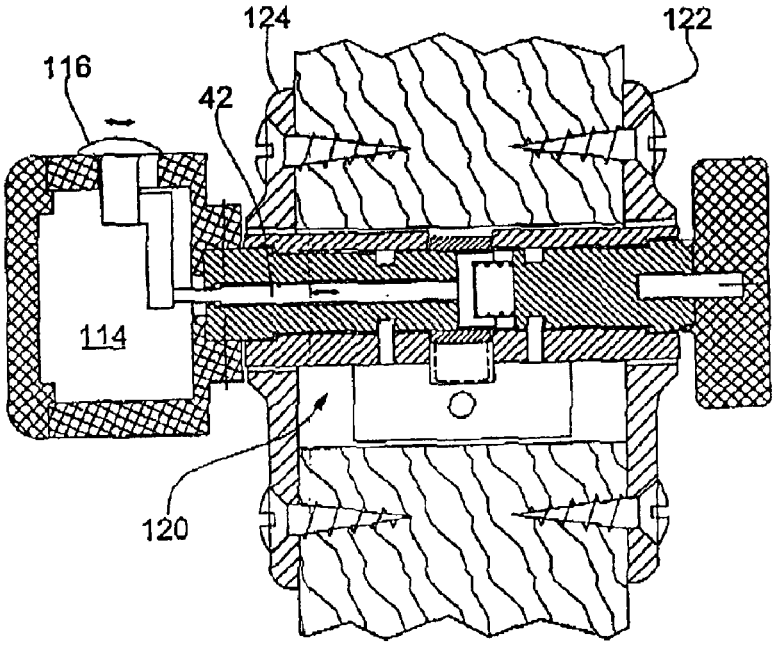
FIG. 7 illustrates a cylinder door lock in the form of a Swiss-type cylinder, and the use of a dummy inner handle.

Depending on the current needs, instead of a coded access handle like the handle assembly 12 with EBD 52 described above, a dummy handle 114 may be mounted to the inner plug 18, as shown in FIG. 7. The dummy handle is shaped so as to keep the door lock in unblocked state, with the clutch 32 engaged, and has no electronic devices therein. The dummy handle 114 may have a mechanical switch 116 to engage or disengage the clutch 32 by pushing the rod 42. The use of changeable handles allows changing operatively the accessibility of individual rooms in a building.

The nature of the vibration signal transmission allows the cylinder lock to be designed as a modular structure. All control circuits, sensors, servomechanisms (drives), batteries, etc. are concentrated in a first module, such as the inner handle 12. A second module is the housing 14 with the plugs 16 and 18, the rotary cam 20 and the clutch 32. The second module has no electric or electronic parts requiring connections to the first module. A third module is the outer handle, such as the outer handle 100 or the knob 22. The three modules can be assembled to each other by simple screws, bolts or other means without disassembling the door lock and without disconnecting and connecting signal or power lines in the door lock.

For example, the second module (a housing with plugs) may be mounted to the door as a mortise lock 120 with escutcheons 122 and 124 shown in FIG. 7. The first module (an inner handle) can be added operatively. This is especially advantageous for cylinder locks of the Swiss type (see lock 2 in FIG. 1) where the housing cannot be extracted without dismantling the escutcheons.

Figure 8:
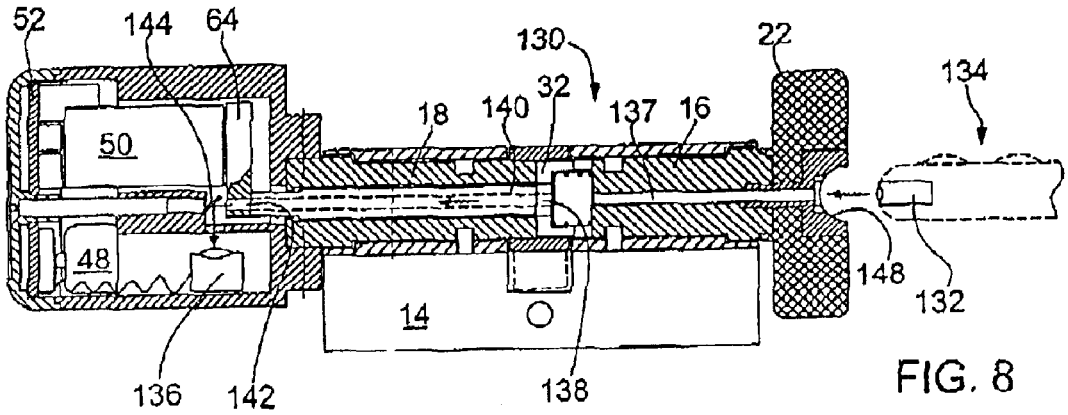
FIG. 8 illustrates a fourth embodiment of the cylinder door lock, with light signal transmission.

The advantageous modular structure with a detachable contactless handle can be implemented also by using other wireless means of signal transmission, for example light and radio waves. FIG. 8 shows yet another embodiment of the cylinder lock 130, employing light emitter 132 in the key 134, and an optic sensor 136 wired to the EBD 52. The emitter and the sensor are connected by a light-guide comprising a through channel 137 in the outer plug 16 and the knob 22, an opening 138 in the clutch 32, a tubular rod 140, an opening 142 in the cap 64, and a mirror 144. The knob 22 is formed with a recess 148 adapted to receive the key 134.

In operation, the key 134 is inserted in the recess 148 so that the light emitter 132 is aligned with the channel 137, and a coded light signal is emitted. The light signal reaches the sensor 136 through the channel 137, the tubular rod 140 and the mirror 144. The EBD 52 decodes the signal and unblocks the door lock as explained above.

Although descriptions of specific embodiments have been presented, it is contemplated that various changes could be made without deviating from the scope of the present invention. For example, the blocking drive may include an electric motor, the light-guide may comprise a transparent solid body, the inner handle may be assembled to the inner plug by dovetail elements, etc.

What is claimed is:

1. A cylinder lock for use in a door lock mounted in a door having an outer and an inner side, said cylinder lock comprising an outer plug, a rotary cam adapted to move a deadbolt in said door lock, and a clutch adapted to engage for rotation said outer plug to said rotary cam, said cylinder lock further comprising an electronic blocking device (EBD) and a drive means adapted to actuate said clutch upon an unblocking command from said EBD generated upon receiving therein an unblocking signal emitted from the outer side of the door, thereby enabling moving said deadbolt by rotation of said outer plug, wherein said cylinder lock comprises an inner handle attached thereto at said inner side of the door, said EBD and said drive means being entirely accommodated within said inner handle;

wherein said inner handle is detachably secured to said cylinder lock solely by one or more mechanical fasteners accessible from the inner side of the door alone a surface free of electric contacts and free of any connections preventing separation of said inner handle from the remaining parts of the cylinder lock after said one or more fasteners is released, whereby said inner handle is detachable from said cylinder lock without a need to dismantle any part of the door or any other part of the lock.

2. A cylinder lock according to claim 1, further comprising an inner plug permanently engaged for rotation to said rotary cam, said inner handle being detachably attached to said inner plug.

3. A cylinder lock according to claim 1, wherein said drive means is a bi-stable solenoid.

4. A cylinder lock according to claim 1, further having a rod extending axially and passing slidingly through an inner plug, between said clutch and said inner handle, whereby said drive means is able to actuate said clutch.

5. A cylinder lock according to claim 1, wherein said unblocking signal is coded, and said EBD is adapted to decode it and generate said unblocking command after decoding the unblocking signal.

6. A cylinder lock according to claim 5, wherein said EBD has a lock access code programmed therein, and is adapted to generate said unblocking command after matching said lock access code to a decoded unblocking signal.

7. A cylinder lock according to claim 6, further comprising a signal emitter adapted to emit said unblocking signal from the outer side of the door.

8. A cylinder lock according to claim 7, wherein said signal emitter is adapted to encode said unblocking signal according to a key access code programmed therein.

9. A cylinder lock according to claim 8, wherein said signal emitter is an electronic panel with a keypad, fixed to the outer side of the door.

10. A cylinder lock according to claim 9, wherein said electronic panel is fixed to said outer plug and is adapted for use as a handle for moving said deadbolt.

11. A cylinder lock according to claim 8, wherein said signal emitter is a movable electronic key.

12. A cylinder lock according to claim 11, wherein said electronic key and said outer plug are configured so as to be able to engage each other for rotation, whereby said electronic key may be used as a handle to move said deadbolt.

13. A cylinder lock according to claim 12, wherein said electronic key has key bit, said key bit and said outer plug being configured as in a conventional mechanical cylinder lock.

14. A cylinder lock according to claim 13, wherein said EBD and said drive means are adapted to be restorably switched into a state where said clutch is continuously actuated, thereby allowing said electronic key to be used as a mechanical key and allowing usage of mechanical keys.

15. A cylinder lock according to claim 11, wherein said electronic key comprises a keypad for programming of said key access code.

16. A cylinder lock according to claim 15, wherein said electronic key is adapted to be fixed to said outer plug, whereby said electronic key may be used both as a handle for moving said deadbolt and as a standing keypad panel for entering said key access code into said EBD.

17. A cylinder lock according to claim wherein said unblocking signal is a mechanical vibration signal, and said signal emitter has an impact head adapted to deliver said vibration signal to the outer side of the door.

18. A cylinder lock according to claim 17, wherein said impact head is of electromagnetic type, or of piezoelectric type or of magnetostriction type.

19. A cylinder lock according to claim 7, wherein said unblocking signal is a light signal, and said door lock has a light-guide adapted to conduct said light signal from said signal emitter to said EBD.

20. A cylinder lock according to claim 19, wherein said light-guide is at least partially a light-transmissive solid body.

21. A cylinder lock according to claim 19, wherein said light-guide is at least partially a bore extending between the outer side and the inner side of said cylinder lock.

22. A cylinder lock according to claim 19, wherein said light-guide is disposed at the axis of said outer plug and an inner plug.

23. A cylinder lock according to claim 22, wherein said light-guide is at least partially disposed in a tubular rod extending axially through said inner plug, between said clutch and said inner handle.

24. A cylinder lock according to claim 7, wherein said signal emitter is adapted to emit at least one of the following unblocking signals:

a) mechanical vibration signal;

b) light signal, and c) radio signal;

and said EBD comprises a respective sensor for receiving said unblocking signal.

25. A signal emitter and a cylinder lock according to claim 1, said signal emitter being adapted to emit said unblocking signal from the outer side of the door.

26. A signal emitter in the form a movable electronic key and a cylinder lock according to claim 1, said signal emitter being adapted to emit said unblocking signal from the outer side of the door.

27. A door lock set comprising a cylinder lock according to claim 1, and a dummy handle, said inner handle being detachably attachable to said cylinder lock without a need to dismantle said door lock or said door or any part of them, said dummy handle being detachably attachable instead of said inner handle and being configured so that, when the dummy handle is attached, said clutch may be continuously actuated, thereby provisionally allowing moving said dead-bolt without said unblocking command.

28. A cylinder lock as in claim 1, wherein said lock is free of electrical connections and other connections that require disassembly for removal of said inner handle from the cylinder lock.

* * * * *